US011639534B2

(12) United States Patent
Li et al.

(10) Patent No.: US 11,639,534 B2
(45) Date of Patent: May 2, 2023

(54) DEVICE FOR DOUBLE-SIDED PROCESSING THROUGH SINGLE SHOT PEENING

(71) Applicant: JIANGSU UNIVERSITY, Zhenjiang (CN)

(72) Inventors: Fuzhu Li, Zhenjiang (CN); Shangshuang Chen, Zhenjiang (CN); Yun Wang, Zhenjiang (CN); Jun Guo, Zhenjiang (CN); Haiyang Fan, Zhenjiang (CN); Yuqin Guo, Zhenjiang (CN); Hong Liu, Zhenjiang (CN); Cheng Zhang, Zhenjiang (CN); Weichao Wan, Zhenjiang (CN); Bin Zhang, Zhenjiang (CN)

(73) Assignee: JIANGSU UNIVERSITY, Zhenjiang (CN)

( * ) Notice: Subject to any disclaimer, the term of this patent is extended or adjusted under 35 U.S.C. 154(b) by 189 days.

(21) Appl. No.: 17/418,227

(22) PCT Filed: Jul. 23, 2020

(86) PCT No.: PCT/CN2020/103661

§ 371 (c)(1),
(2) Date: Jun. 24, 2021

(87) PCT Pub. No.: WO2021/237906

PCT Pub. Date: Dec. 2, 2021

(65) Prior Publication Data

US 2023/0080208 A1 Mar. 16, 2023

(30) Foreign Application Priority Data

May 29, 2020 (CN) ..... 202010476251.2

(51) Int. Cl.
*B24C 1/10* (2006.01)
*C21D 7/06* (2006.01)

(52) U.S. Cl.
CPC . *C21D 7/06* (2013.01); *B24C 1/10* (2013.01)

(58) Field of Classification Search
CPC .. B24C 1/10; B21D 31/06; C21D 7/06; Y10T 29/479

(Continued)

(56) References Cited

U.S. PATENT DOCUMENTS 6,939,205 B2 * 9/2005 Hopf ..... B24C 1/10 451/38
7,644,599 B2 * 1/2010 Hoffmann-Ivy ..... B24C 1/10 451/39

(Continued)

FOREIGN PATENT DOCUMENTS

CN 201271842 Y 7/2009
CN 203317232 U 12/2013

(Continued)

*Primary Examiner* — Edward T Tolan
(74) *Attorney, Agent, or Firm* — Bayramoglu Law Offices LLC

(57) ABSTRACT

A device for double-sided processing through single shot peening includes: a shot peening system, a workpiece clamping mechanism for clamping a workpiece, and a rebound system. The workpiece is provided with a first through-hole, and the first through-hole directly faces a nozzle. The rebound system includes a reflecting surface, an open container, and a reflecting surface gripping unit. The reflecting surface includes an upper reflecting surface, a middle reflecting surface, and a lower reflecting surface. The middle reflecting surface is provided with a second through-hole. The upper reflecting surface and the lower reflecting surface are both made of flexible elastic materials and are both provided with waterproof layers. A partition plate is disposed in the open container and partitions the open container into a first cavity and a second cavity. The second (Continued)

cavity is provided with a filling liquid, and the partition plate is slidable in the open container.

8 Claims, 3 Drawing Sheets

(58) Field of Classification Search
USPC ..... 72/53
See application file for complete search history.

(56) References Cited

U.S. PATENT DOCUMENTS

| | | | | |
|---|---|---|---|---|
| 8,650,920 | B2 * | 2/2014 | Bayer | B24C 1/083 29/90.7 |
| 9,149,911 | B2 * | 10/2015 | Haverty | B05D 3/12 |
| 2011/0252850 | A1 * | 10/2011 | Lu | A61F 2/30767 72/53 |
| 2020/0254586 | A1 * | 8/2020 | Sanders | B08B 3/12 |

FOREIGN PATENT DOCUMENTS

| | | | | |
|---|---|---|---|---|
| CN | 107488779 | A | 12/2017 | |
| JP | S6368368 | A | 3/1988 | |
| JP | H05138535 | A | 6/1993 | |
| KR | 20120067151 | A * | 6/2012 | B24C 1/10 |

* cited by examiner

DEVICE FOR DOUBLE-SIDED PROCESSING THROUGH SINGLE SHOT PEENING

CROSS REFERENCE TO THE RELATED APPLICATIONS

This application is the national phase entry of International Application No. PCT/CN2020/103661, filed on Jul. 23, 2020, which is based upon and claims priority to Chinese Patent Application No. 202010476251.2, filed on May 29, 2020, the entire contents of which are incorporated herein by reference.

TECHNICAL FIELD

The present invention relates to the technical field of shot peening, and in particular, to a device for double-sided processing through single shot peening.

BACKGROUND

With the rapid development of society and upgrading of science and technology, there are increasingly high requirements for surface quality of mechanical parts. Surface modification processing on parts has been one of the areas of great concern for mechanical processing, and shot peening in parts processing is an effective way to enhance comprehensive mechanical properties of parts surfaces and has been widely applied in surface modification processing on parts in various areas.

Shot peening is a surface strengthening process widely used in factories, namely, a cold working process bombarding a surface of a workpiece with shots and implanting residual compressive stress to enhance fatigue strength of the workpiece. Shot peening is widely used to improve mechanical strength, wear resistance, fatigue resistance, corrosion resistance, and so on of parts. Shot peening has the advantages of simple equipment, low costs, no limitation on the shape and position of the workpiece, and easy operation.

However, in current shot peening, only single-sided processing can be realized through single shot peening, which greatly reduces the efficiency of shot peening.

SUMMARY

In view of the deficiencies in the prior art, the present invention provides a device for double-sided processing through single shot peening, which can realize processing on both sides of a workpiece during single shot peening.

The present invention achieves the aforementioned technical objective by the following technical means.

A device for double-sided processing through single shot peening includes:

a shot peening system, including a nozzle;

a workpiece clamping mechanism, disposed below the shot peening system and configured for clamping a workpiece, wherein the workpiece is provided with a first through-hole, and the first through-hole directly faces the nozzle; and a rebound system, including a reflecting surface, an open container, and a reflecting surface gripping unit, wherein the reflecting surface includes an upper reflecting surface, a middle reflecting surface, and a lower reflecting surface, the middle reflecting surface is provided with a second through-hole, the second through-hole is coaxial with the first through-hole, the upper reflecting surface and the lower reflecting surface are both made of flexible elastic materials and are both provided with waterproof layers, a partition plate is disposed in the open container, the partition plate partitions the open container into a first cavity and a second cavity, the second cavity is provided with a filling liquid, the partition plate is slidable in the open container, a top surface of the second cavity is open, and the lower reflecting surface is connected to the opening in a sealed manner;

wherein the partition plate is pushed to move toward the second cavity, the filling liquid presses the lower reflecting surface, and the lower reflecting surface swells upward from the second through-hole to form a sphere.

Further, the device further includes a gas pump, wherein the gas pump is in communication with the first cavity, the first cavity is provided with a gas, and the gas pump is configured for adjusting a gas pressure in the first cavity.

Further, the device further includes a control system, wherein the control system includes a control unit, a pressure gauge, and a sensor unit, the sensor unit is configured for measuring a distance between a bottom end of the nozzle and an upper surface of the workpiece and measuring an aperture size of the first through-hole, the pressure gauge is configured for measuring the pressure in the first cavity, the sensor unit, the gas pump, and the pressure gauge are all connected to the control unit, and the control unit controls operation of the gas pump according to signals transmitted by the sensor unit and the pressure gauge.

Further, the workpiece clamping mechanism includes a left clamp, a right clamp, a left supporting plate, and a right supporting plate, the workpiece is placed on the left supporting plate and the right supporting plate, and the left clamp and the right clamp grip the workpiece from two sides of the workpiece.

Further, the reflecting surface gripping mechanism includes a lifting mechanism, a connecting rod, an upper clamping plate, and a lower clamping plate, a top end of the connecting rod is connected to the lifting mechanism, a bottom end of the connecting rod is connected to the upper clamping plate, the lower clamping plate is fixedly disposed, an upper surface of the lower clamping plate is flush with an upper surface of the open container, and the lifting mechanism is connected to the control unit.

Further, the upper reflecting surface and the lower reflecting surface both have fabric structures.

Further, the device further includes a lifting platform, the open container is mounted on the lifting platform, the lifting platform is connected to the control unit, and the control unit controls rise and fall of the lifting platform according to signals transmitted by the sensor unit.

Further, the lifting platform is provided with a supporting plate, and the open container is mounted on the supporting plate.

The beneficial effects of the present invention:

1. The middle reflecting surface of the reflecting surface in the present invention is provided with the second through-hole, the upper reflecting surface and the lower reflecting surface are made of fabric elastic materials and have extensibility. The partition plate is pushed so that the filling liquid presses the lower reflecting surface upward, so as to form a sphere at the second through-hole. The sphere is elastic and can rebound shots to realize shot peening on a back side of a workpiece. In this way, during single shot peening of the workpiece, not only a machined surface of the workpiece can be processed, but also a back side of the workpiece can be processed, thereby avoiding the limitation that only a single side can be processed through single shot peening during conventional shot peening.

2. The control system in the present invention obtains the distance between the bottom end of the nozzle and the upper surface of the workpiece and the aperture size of the first through-hole through the sensing unit, and analyzes the data, so as to set the size of the sphere of the reflecting surface by controlling operation of the gas pump to enable better reflection shot peening.

LIST OF REFERENCE SIGNS

1—control center, 2—gas pump, 3—pressure gauge, 4—gas container, 5—partition plate, 6—filling liquid, 7—left supporting plate, 8—left clamp, 9—workpiece, 10—multi—function sensor, 11—nozzle, 12—shot, 14—right clamp, 15—right supporting plate, 16—extraction device, 17—connecting rod, 18—upper clamping plate, 19—lower clamping plate, 20—second cavity, 21—supporting plate, 22—lifting platform, 23—upper reflecting surface, 24—middle reflecting surface, 25—lower reflecting surface.

DETAILED DESCRIPTION OF THE EMBODIMENTS

Embodiments of the present invention are described in detail below, and examples of the embodiments are illustrated in the accompanying drawings throughout which the same or similar reference signs indicate the same or similar elements or elements having the same or similar functions. The embodiments described below with reference to the accompanying drawings are exemplary, intended to explain the present invention and not to be construed as limiting the present invention.

In the description of the present invention, it is to be understood that the terms "center," "longitudinal," "transverse," "length," "width," "thickness," "up," "down," "axial," "radial," "vertical," "horizontal," "inside," "outside," and the like indicate the direction or position relationship based on the direction or position relationship shown in the accompanying drawings, which is only for the convenience of describing the present invention and simplifying the description, rather than indicating or implying that the device or element referred to must have a specific direction, or be constructed and operated in a specific direction, so it cannot be construed as a limitation to the present invention. In addition, the terms "first" and "second" are only used for the purpose of description and cannot be construed as indicating or implying relative importance or implicitly specifying the number of the indicated technical features. Thus, a feature defined with "first" or "second" may include one or more such features, either explicitly or implicitly. In the description of the present invention, "a plurality of" means two or more than two, unless otherwise specifically defined.

In the present invention, unless otherwise specified and defined, the terms such as "mount," "connect," "connected," and "fixed" should be understood in a broad sense. For example, it may be fixed connection, detachable connection, or integrated connection; it may be mechanical connection or electrical connection; it may be direct connection, indirect connection through an intermediate medium or communication between two elements. For those of ordinary skill in the art, the specific meaning of the above terms in the present invention can be understood according to specific situations.

A device for double-sided processing through single shot peening according to an embodiment of the present invention is specifically described below with reference to the accompanying drawings first.

Figure 1:
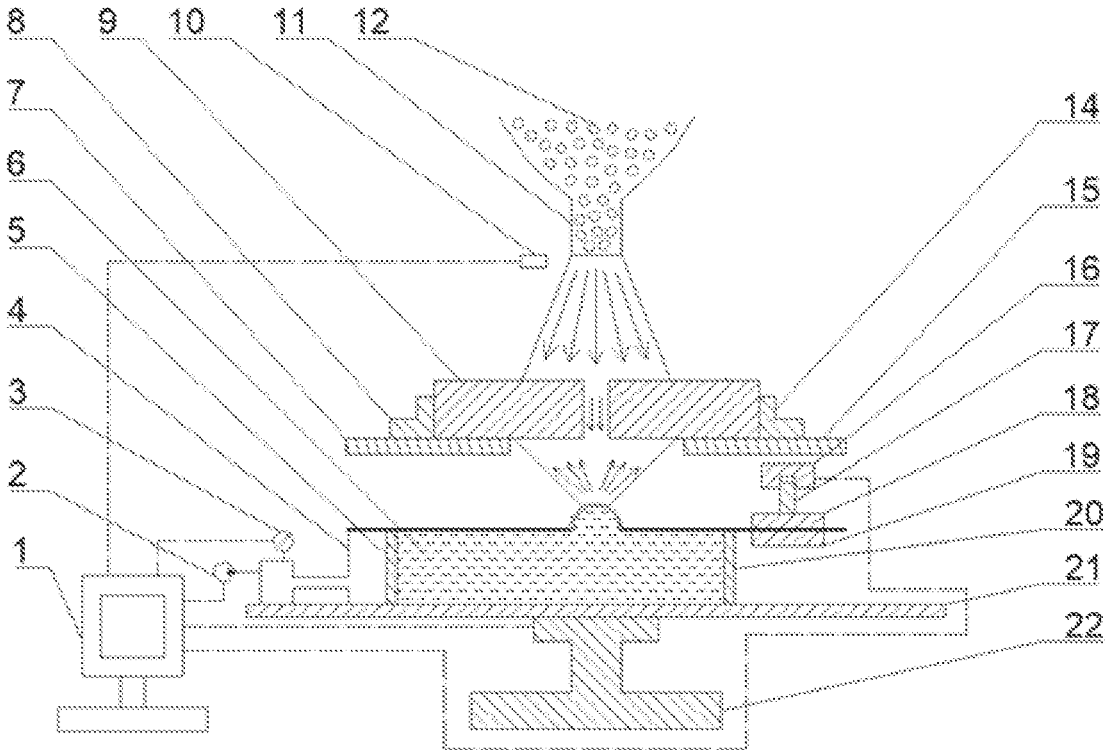
FIG. 1 is a schematic structural view of a device for double-sided processing through single shot peening according to an embodiment of the present invention.
Figure 2:
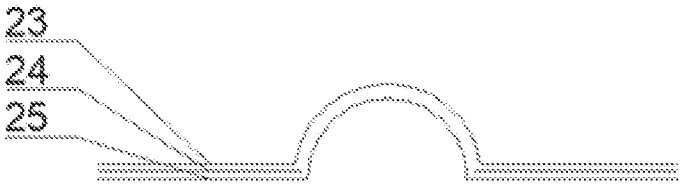
FIG. 2 is a schematic structural view of a reflecting surface in FIG. 1.
Figure 3:
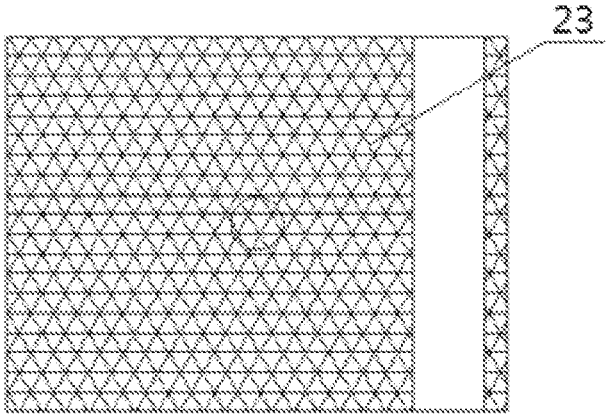
FIG. 3 is a top view of the reflecting surface and a clamping plate mechanism in FIG. 1.

Referring to FIG. 1 to FIG. 3, a device for double-sided processing through single shot peening according to an embodiment of the present invention includes a shot peening system, a workpiece clamping mechanism, a lifting platform 22, a rebound system, and a control system.

Specifically, the shot peening system is used for performing shot peening, and includes a nozzle 11, where the nozzle 11 sprays shots 12 to a workpiece.

The workpiece clamping mechanism is disposed below the shot peening system and configured for clamping the workpiece 9, where the workpiece 9 is provided with a first through-hole. The workpiece clamping mechanism in this embodiment includes a left clamp 8, a right clamp 14, a left supporting plate 7, and a right supporting plate 15. Two ends of the workpiece 9 are placed on the left supporting plate 7 and the right supporting plate 15, so that the first through-hole is located between the left supporting plate 7 and the right supporting plate 15, and the left clamp 8 and the right clamp 14 grip the workpiece 9 from two sides of the workpiece 9 to realize clamping of the workpiece 9.

The rebound system is disposed below the workpiece 9 and configured for rebounding shots to realize shot peening on a back side of the workpiece 9. Specifically, the rebound system includes a reflecting surface, an open container 4, a reflecting surface clamp, and a gas pump 2. The lifting platform 22 is provided with a supporting plate 21, and the open container 4 is mounted on the supporting plate 21. The open container 4 is provided with a partition plate 5, the partition plate 5 partitions the open container 4 into a first cavity and a second cavity 20, the second cavity 20 is provided with a filling liquid 6, and the partition plate 5 is slidable in the open container 4 to change volumes of the first cavity and the second cavity.

As shown in FIG. 2, the reflecting surface includes an upper reflecting surface 23, a middle reflecting surface 24, and a lower reflecting surface 25. The middle reflecting surface 24 is provided with a second through-hole, and the second through-hole is coaxial with the first through-hole. As shown in FIG. 3, the upper reflecting surface 23 and the lower reflecting surface 25 are both made of flexible elastic materials and have fabric structures, and thus have extensibility. A top surface of the second cavity 20 is open, and the lower reflecting surface 25 is connected to the opening in a sealed manner. The upper reflecting surface 23 and the lower reflecting surface 25 are both provided with waterproof layers to prevent leakage of the filling liquid 6.

The gas pump 2 is in communication with the first cavity, the first cavity is provided with a gas, and the gas pump 2 can adjust a gas pressure in the first cavity to push the partition plate 5 to move. When the partition plate 5 moves toward the second cavity 20, the filling liquid 6 presses the lower reflecting surface 25 upward, so as to form a sphere at the second through-hole. The sphere is elastic and can rebound shots to realize shot peening on the back side of the workpiece.

The reflecting surface gripping mechanism includes a lifting mechanism 16, a connecting rod 17, an upper clamping plate 18, and a lower clamping plate 19. A top end of the connecting rod 17 is connected to the lifting mechanism 16, a bottom end of the connecting rod 17 is connected to the upper clamping plate 18, the lower clamping plate 19 is fixedly disposed, and an upper surface of the lower clamping plate 19 is flush with an upper surface of the open container 4. The vertical movement of the upper clamping plate 18 can be realized through the operation of the lifting mechanism 16, so as to realize clamping of the reflecting surface.

The control system includes a control unit 1, a pressure gauge 3, and a sensor unit 10. The sensor unit 10 is configured for measuring a distance between a bottom end of the nozzle 11 and an upper surface of the workpiece 9 and measuring an aperture size of the first through-hole; the above purpose may be specifically achieved by providing two sensors. The pressure gauge 3 is configured for measuring the pressure in the first cavity. The sensor unit 10, the gas pump 2, the lifting mechanism 16, and the pressure gauge 3 are all connected to the control unit. The control unit controls operation of the gas pump 2 according to signals transmitted by the sensor unit 10 and the pressure gauge 3, so as to control the movement of the partition plate 5, thereby controlling the size of the sphere of the reflecting surface. Meanwhile, the control unit 1 controls rise and fall of the lifting platform 22 so that the reflecting surface is at the optimum position. In this embodiment, the control unit 1 may further automatically control clamping of the reflecting surface by controlling the lifting mechanism 16.

The working process of a device for double-sided processing through single shot peening according to an embodiment of the present invention:

The workpiece is placed above the left supporting plate 7 and the right supporting plate 15 and is gripped with the left clamp 8 and the right clamp 14. The control unit 1 controls the operation of the lifting mechanism 16, so that the upper clamping plate 18 and the lower clamping plate 19 grip a reflecting surface A. The sensor unit 10 measures a distance from the nozzle 11 to the upper surface of the workpiece 9 and an aperture size of the first through-hole in the workpiece 9, and transmits measured data to the control unit 1. The control unit 1 analyzes an optimum position of the reflecting surface with respect to the workpiece and an optimum size of a sphere on the reflecting surface according to acquired data, so as to control operation of the lifting platform 22 and the gas pump 2 and start operation of the shot peening system to perform shot peening. One part of shots 12 is configured for processing the upper surface of the workpiece 9, and the other part of shots 12 is sprayed to the sphere of the reflecting surface through the first through-hole. The sphere ejects the shots 12 to the back side of the workpiece 9 to realize shot peening on the back side of the workpiece 9. In this way, during single shot peening of the workpiece, not only the machined surface of the workpiece can be processed, but also the back side of the workpiece can be processed, thereby avoiding the limitation that only a single side can be processed through single shot peening during conventional shot peening.

In the description of this specification, the description with reference to the term "an embodiment," "some embodiments," "examples," "specific examples," "some examples" or the like means that specific features, structures, materials, or characteristics described in conjunction with the embodiment or example are included in at least one embodiment or example of the present invention. In this specification, the schematic expressions of the aforementioned terms do not necessarily refer to the same embodiment or example. Furthermore, the specific features, structures, materials, or characteristics described may be combined in a suitable manner in any one or more embodiments or examples.

Although the embodiments of the present invention have been shown and described above, it can be understood that the embodiments are exemplary and should not be construed as limiting the present invention. Those of ordinary skill in the art can make changes, modifications, replacements, and variations to the embodiments without departing from the principle and purpose of the present invention.

What is claimed is:

1. A device for double-sided processing through single shot peening, comprising:

a shot peening system, comprising a nozzle;

a workpiece clamping mechanism, disposed below the shot peening system and configured for clamping a workpiece, wherein the workpiece is provided with a first through-hole, and the first through-hole directly faces the nozzle; and, a rebound system, comprising a reflecting surface, an open container, and a reflecting surface gripping unit, wherein the reflecting surface comprises an upper reflecting surface, a middle reflecting surface, and a lower reflecting surface, the middle reflecting surface is provided with a second through-hole, the second through-hole is coaxial with the first through-hole, the upper reflecting surface and the lower reflecting surface are both made of flexible elastic materials and are both provided with waterproof layers, a partition plate is disposed in the Open container, the partition plate partitions the open container into a first cavity and a second cavity, the second cavity is provided with a filling liquid, the partition plate is slidable in the open container, a top surface of the second cavity is provided with an open, and the lower reflecting surface is connected to the opening in a sealed manner;

wherein the partition plate is pushed to move toward the second cavity, the filling liquid presses the lower reflecting surface, and the lower reflecting surface swells upward from the second through-hole to form a sphere.

2. The device for the double-sided processing through the single shot peening according to claim 1, further comprising a gas pump, wherein the gas pump is in communication with the first cavity, the first cavity is provided with a gas, and the gas pump is configured for adjusting a gas pressure in the first cavity.

3. The device for the double-sided processing through the single shot peening according to claim 2, further comprising a control system, wherein the control system comprises a control unit, a pressure gauge, and a sensor unit, the sensor unit is configured for measuring a distance between a bottom end of the nozzle and an upper surface of the workpiece and measuring an aperture size of the first through-hole, the pressure gauge is configured for measuring the gas pressure in the first cavity, the sensor unit, the gas pump, and the pressure gauge are all connected to the control unit, and the control unit controls operation of the gas pump according to signals transmitted by the sensor unit and the pressure gauge.

4. The device for the double-sided processing through the single shot peening according to claim 1, wherein the workpiece clamping mechanism for clamping the workpiece comprises a left clamp, a right clamp, a left supporting plate, and a right supporting plate, the workpiece is placed on the left supporting plate and the right supporting plate, and the left clamp and the right clamp grip the workpiece from two sides of the workpiece.

5. The device for the double-sided processing through the single shot peening according to claim 1, wherein the reflecting surface gripping unit comprises a lifting mechanism, a connecting rod, an upper clamping plate, and a lower clamping plate, a top end of the connecting rod is connected to the lifting mechanism, a bottom end of the connecting rod is connected to the upper clamping plate, the lower clamping plate is fixedly disposed, an upper surface of the lower clamping plate is flush with an upper surface of the open container, and the lifting mechanism is connected to a control unit.

6. The device for the double-sided processing through the single shot peening according to claim 1, wherein the upper reflecting surface and the lower reflecting surface both have fabric structures.

7. The device for the double-sided processing through the single shot peening according to claim 3, further comprising a lifting platform, wherein the open container is mounted on the lifting platform, the lifting platform is connected to the control unit, and the control unit controls a rise and fall of the lifting platform according to signals transmitted by the sensor unit.

8. The device for the double-sided processing through the single shot peening according to claim 3, wherein a lifting platform is provided with a supporting plate, and the open container is mounted on the supporting plate.

* * * * *